US007017663B2

(12) United States Patent
Polderman et al.

(10) Patent No.: US 7,017,663 B2
(45) Date of Patent: Mar. 28, 2006

(54) SYSTEM FOR PRODUCING DE-WATERED OIL

(75) Inventors: Gerardus Hugo Polderman, Amsterdam (NL); Paulus Henricus Joannes Verbeek, Rijswijk (NL); Jelle Sipke Bouma, Amsterdam (NL); Eric Johannes Puik, Amsterdam (NL)

(73) Assignee: Shell Oil Company, Houston, TX (US)

( * ) Notice: Subject to any disclaimer, the term of this patent is extended or adjusted under 35 U.S.C. 154(b) by 162 days.

(21) Appl. No.: 10/149,312

(22) PCT Filed: Dec. 14, 2000

(86) PCT No.: PCT/US00/12862

§ 371 (c)(1),
(2), (4) Date: Jun. 10, 2002

(87) PCT Pub. No.: WO01/44620

PCT Pub. Date: Jun. 21, 2001

(65) Prior Publication Data

US 2003/0205522 A1 Nov. 6, 2003

(30) Foreign Application Priority Data

Dec. 14, 1999 (EP) ..... 99204300
Jul. 6, 2000 (EP) ..... 00305704

(51) Int. Cl.
*E21B 43/38* (2006.01)

(52) U.S. Cl. ..... 166/265; 166/105.1; 210/744

(58) Field of Classification Search ..... 166/265, 166/266, 105.1, 207; 210/744, 789, 801, 210/804

See application file for complete search history.

(56) References Cited

U.S. PATENT DOCUMENTS

| | | | | |
|---|---|---|---|---|
| 4,280,557 | A | 7/1981 | Bodine | 166/177 |
| 4,390,067 | A | 6/1983 | Willman | |
| 4,583,601 | A | 4/1986 | Té chy | 173/134 |
| 5,402,851 | A | 4/1995 | Baiton | |
| 5,443,120 | A | 8/1995 | Howell | |
| 5,595,243 | A | 1/1997 | Maki, Jr. et al. | 166/177.2 |
| 5,715,891 | A | 2/1998 | Graham | |
| 5,857,519 | A | 1/1999 | Bowlin et al. | |
| 5,992,521 | A | 11/1999 | Bergren et al. | |
| 6,277,286 | B1 * | 8/2001 | S.o slashed.ntvedt et al. | 166/250.03 |

FOREIGN PATENT DOCUMENTS

| | | |
|---|---|---|
| FR | 2 603 205 | 3/1988 |
| FR | 2 603 206 | 3/1988 |
| GB | 2 326 895 A | 1/1999 |
| WO | 98 25005 | 6/1998 |
| WO | 98 41304 | 9/1998 |
| WO | 98 50679 | 11/1998 |

* cited by examiner

*Primary Examiner*—William Neuder

(57) ABSTRACT

System for producing de-watered oil from an underground formation to the surface, which system comprises a reception well having a substantially horizontal or inclined section for primary oil/water separation of the well fluid; a water discharge system having an upstream end that is capable of receiving during normal operation liquid from the lower region of the downstream part of the reception well; and a secondary underground oil/water separator having an upstream end that is capable of receiving during normal operation liquid from the upper region of the downstream part of the reception well, the secondary separator having an outlet for de-watered oil that is in fluid communication with the inlet of a production well and an outlet for a water-enriched component that is in fluid communication with the water discharge system.

21 Claims, 6 Drawing Sheets

SYSTEM FOR PRODUCING DE-WATERED OIL

BACKGROUND OF THE INVENTION

FIELD OF THE INVENTION

The present invention relates to a system for producing de-watered oil from an underground formation.

In the specification and in the claims, the expression 'well fluid' will be used to refer to a fluid comprising hydrocarbon oil and water that is received by a system according to the present invention from an underground formation. Further, hydrocarbon oil will be referred to as oil.

The present invention relates in particular to a system, wherein a well fluid can be separated underground, such that oil is produced to the surface that has been de-watered below the surface. It will be understood, that the surface may also be the bottom of the sea.

International patent application publication No. WO 98/41304 discloses a system for producing oil from an underground formation in accordance with the pre-amble of claim 1, which system comprises

- a production well extending downwardly from the surface and having an inlet below the surface;
- a reception well penetrating the underground formation and capable of receiving well fluid therefrom, wherein the downstream part of the reception well comprises a substantially horizontal section; and
- a water discharge system having an upstream end that is capable of receiving liquid from the lower region of the horizontal section,
- wherein the inlet of the production well is arranged to receive liquid from the upper region of the horizontal section.

During normal operation of the known system, the flow of well fluid is selected such that the well fluid is separated in the horizontal section. Liquid layers are formed in the upper and lower regions of the horizontal section, and an interface is formed between the layers. Near the downstream end of the horizontal section the liquid flowing in the lower region is a water-rich component, and the liquid flowing in the upper region is an oil-rich component of the well fluid. The oil-rich component is produced to the surface, and the remaining water-rich component is disposed. Optionally, the water-rich phase is subjected to a further separation step.

The known system provides only bulk removal of water. In order to obtain a substantially water-free oil having a water concentration that is sufficiently low to allow pipeline transport of the oil, the known system further comprises an oil-water separator at the surface. Furthermore it is disclosed in the publication, that for this bulk removal of water the level of the interface should be kept within narrow limits.

Not only is the known system directed to the bulk removal of water, but it is also directed to getting a low oil concentration in the water-rich component, and if necessary this is done at the cost of a higher water concentration of the produced oil.

Applicant has reviewed the separation behaviour of a mixture of oil and water using a proprietary model. The model calculations, of which results will be discussed with reference to FIGS. 1 and 2 below, have revealed that for realistic operation conditions in horizontal wells (including flow rate of the well fluid, length and diameter of the horizontal section), the concentration of water in the oil-rich component is considerable. In practice this will require de-watering of the produced oil before it can be transported from the wellhead, e.g. through a pipeline.

In this regard it is observed, that unrealistic operating conditions were used to arrive at the results depicted in FIGS. 2 and 3 of the above-mentioned International patent application.

UK Patent application No. GB 2 326 895 A discloses an apparatus for producing fluid containing hydrocarbons and water from an underground formation by using a single underground separation step, in order to permit reduction of the separation equipment at the surface. The apparatus comprises an inclined well section wherein at least two separate flow paths are arranged, which flow paths are split by means of baffles, pipes and the like. Fluid received from a hydrocarbon enriched part in the well section is directly pumped to the surface, and fluid received from a water enriched part in the well section can be injected back into the formation. At least one pump is operationally controlled by a detector which is placed in the vicinity of the splitting means.

SUMMARY OF THE INVENTION

It is an object of the present invention to provide a system for producing oil from an underground formation to the surface, wherein the oil can be de-watered below the surface, such that the water concentration of the produced oil is sufficiently low that no further de-watering at the surface is needed before the oil can be transported away from the wellhead.

It is another object of the invention to provide such a system which can be used under realistic operating conditions.

It is yet another object of the invention to provide a system for underground separation of a well fluid, which system is easy to operate, robust and efficient.

To this end, in accordance with the present invention is provided a system for producing de-watered oil from an underground formation to the surface, which system comprises

- a production well extending downwardly from the surface and having an inlet below the surface;
- a reception well penetrating the underground formation and capable of receiving well fluid therefrom, wherein the downstream part of the reception well comprises a substantially horizontal or inclined section for primary oil/water separation of the well fluid;
- a water discharge system having an upstream end that is capable of receiving during normal operation liquid from the lower region of the downstream part of the reception well; and
- a secondary underground oil/water separator, characterised in that the secondary separator has an upstream end that is capable of receiving during normal operation liquid from the upper region of the downstream part of the reception well, the secondary separator having an outlet for de-watered oil that is in fluid communication with the inlet of the production well and an outlet for a water-enriched component that is in fluid communication with the water discharge system.

The present invention is based on the insight gained by Applicant by using a proprietary model, that well fluid flowing in a substantially horizontal or inclined well section separates under realistic operating conditions such that near the downstream end of the horizontal or inclined section the water concentration (vol %) in the upper, oil-rich component is significantly larger than the oil concentration (vol %) in the lower, water-rich component. In particular it has been found, that the oil-rich component under realistic operating conditions contains more than 10 vol % of water. The water-rich component can have an oil concentration between 0.01 vol % and 0.1 vol %. In the specification and in the claims the expressions 'upper region' and 'lower region' are used in connection with the horizontal section to refer to the space above a horizontal plane intersecting the horizontal section, and the expressions also refer to a space of the same form when used in relation to an inclined section. The expression "substantially horizontal" section is used in order to account for the fact that directional underground drilling in practice may result in deviations from an intended horizontal direction. An inclined section is a well section that is not substantially horizontal, and can have an inclination angle of up to 80 degrees from a horizontal plane, wherein the well section is upwardly inclined from its upstream part where well fluid is received.

BRIEF DESCRIPTION OF THE DRAWINGS

The present invention will now be described by way of example in more detail with reference to the accompanying drawings, wherein.

DETAILED DESCRIPTION OF THE PREFERRED EMBODIMENT

The invention will be illustrated in more detailed on the basis of the following examples together with the figures. The examples should not be construed to limit the scope of the invention.

Figure 1:
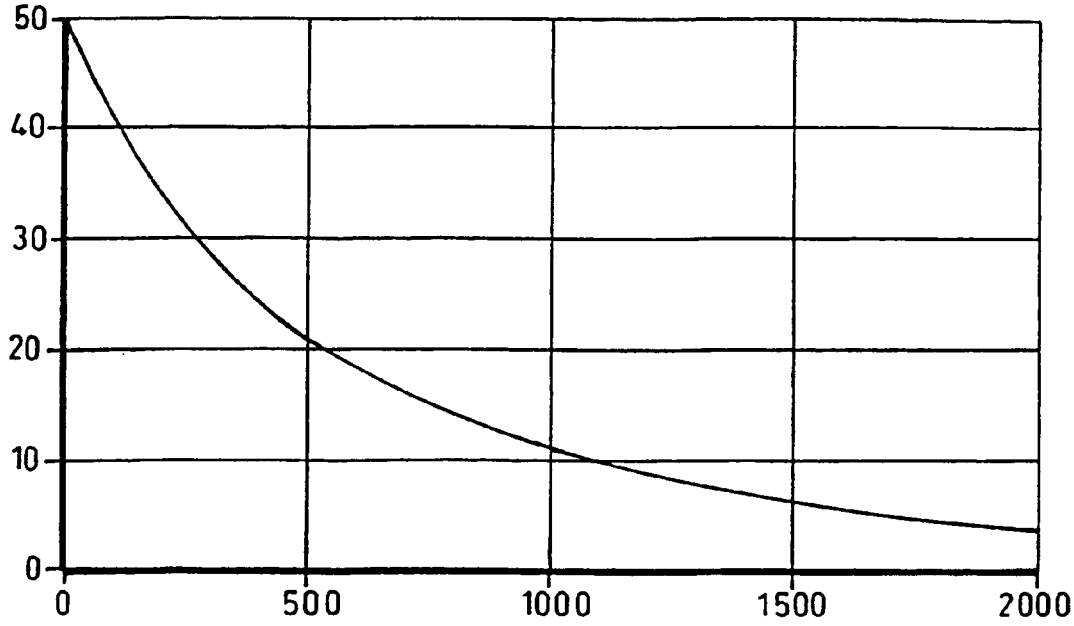
FIG. 1 shows a first result of model calculations of the separation of a well fluid in a horizontal pipe.

Reference is now made to FIG. 1, in which are displayed results of calculations that have been performed using the model developed by Applicant. FIG. 1 shows, for an oil/water mixture flowing in a horizontal pipe, the calculated water concentration (vol %) of the oil-rich component in the upper region at the end of the horizontal pipe (ordinate) as a function of the length of the horizontal pipe in meters (abscissa).

The calculations were performed by applying the proprietary model, which model allows to estimate parameters that characterize the separation of a flowing oil/water mixture in horizontal pipes into an upper, oil-rich component and a lower, water-rich component. The model takes into account a number of input parameters, including viscosities and flow rates of oil and water, pipe diameter, initial droplet size. The model has been experimentally verified under field conditions in horizontal pipes.

For the calculations input parameters have been selected such that they are typical and fall within the range of realistic operating conditions for the application of the present invention. The selected input parameters include oil density 790 kg/m$^3$, viscosity of the oil 1 mPa.s, flow rate 2000 m$^3$/day, diameter of the pipe 0.23 m, overall water concentration of the mixture 50 vol %, initial water droplet size 50 μm.

As will be clear from FIG. 1, the concentration of water in the oil-rich component decreases with increasing length of the horizontal pipe. The model predicts, that at a length of 1000 m the oil-rich component contains ca. 12 vol % water.

Figure 2:
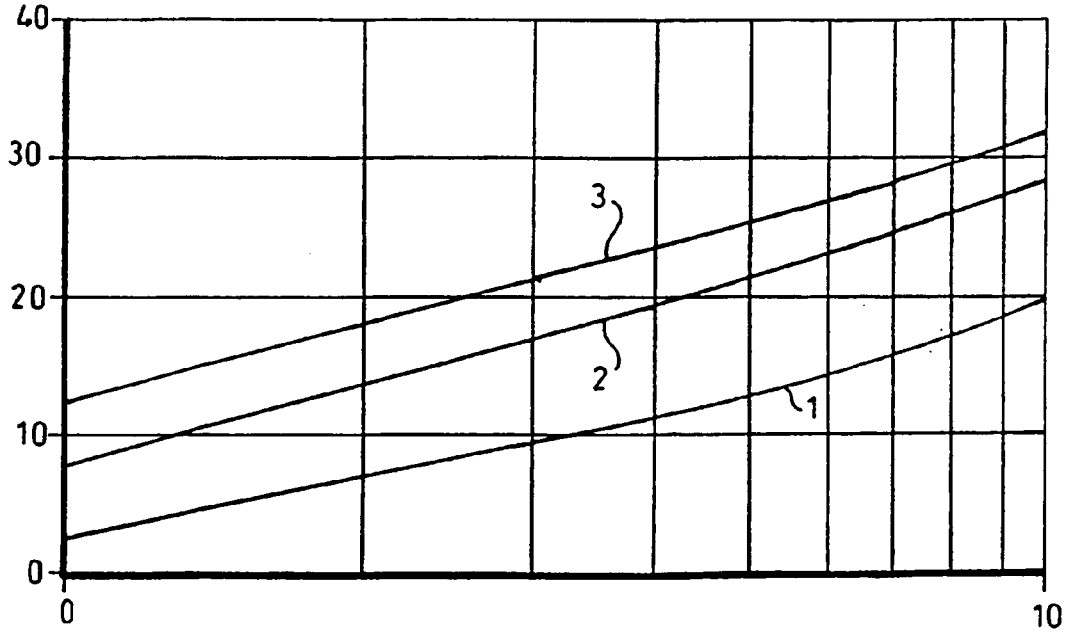
FIG. 2 shows a second result of model calculations of the separation of a well fluid in a horizontal pipe.

For other results of the model calculations reference is made to FIG. 2. FIG. 2 shows, for an oil/water mixture flowing in a horizontal pipe, the calculated water concentration (vol %) of the oil-rich component in the upper region at the end of a horizontal pipe having a length of 1000 m (ordinate), as a function of the viscosity of the oil in mPa.s (abscissa), for flow rates of 1000 m$^3$/day (curve 1), 1600 m$^3$/day (curve 2) and 2000 m$^3$/day (curve 3). The other input parameters were the same as used for the calculation of FIG. 1.

Figure 3:
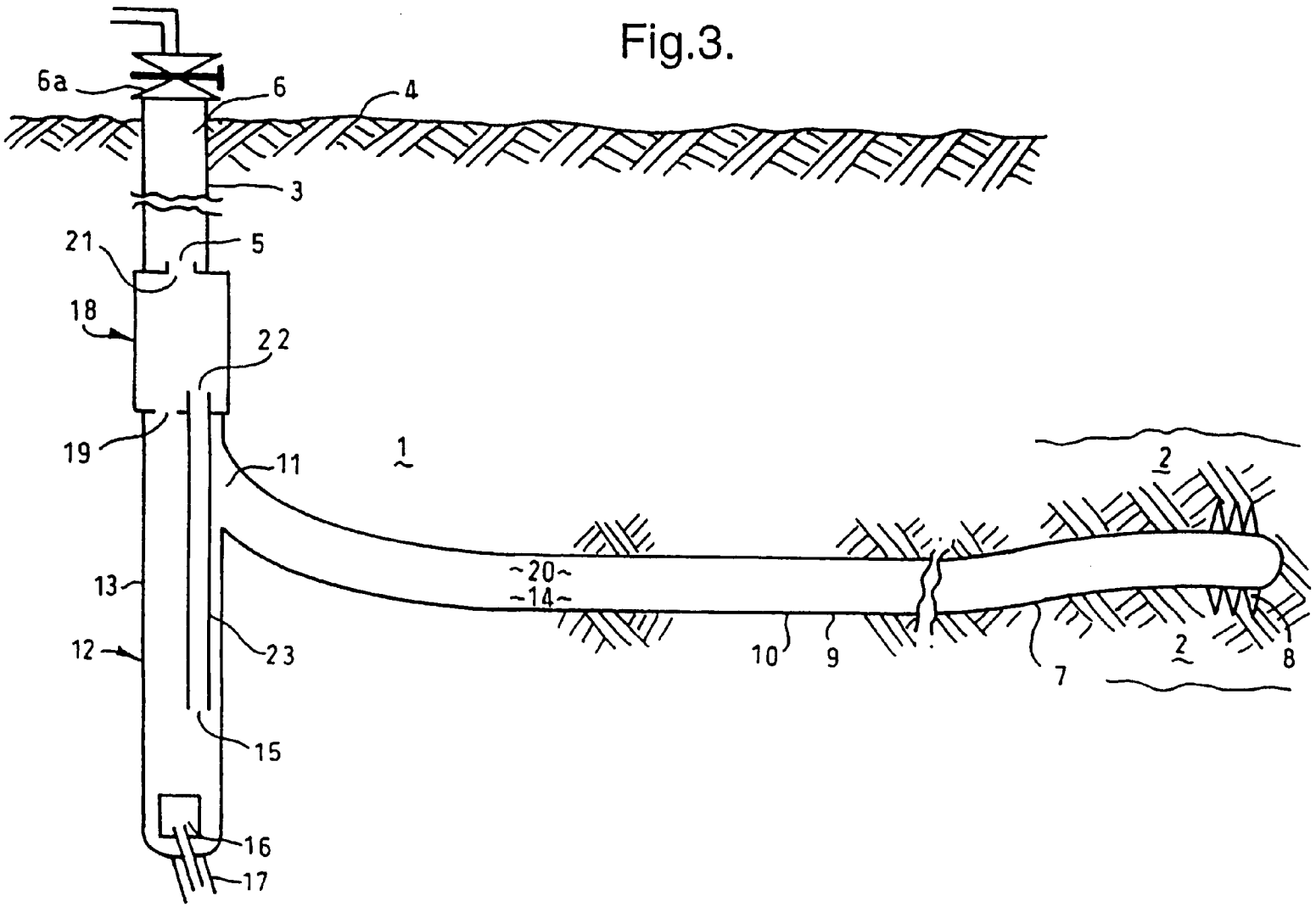
FIG. 3 shows schematically a first embodiment of the present invention.

Reference is now made to FIG. 3. The system 1 for producing de-watered oil from an underground formation 2 comprises a production well 3 extending downwardly from the surface 4 and having an inlet 5 below the surface 4 and an outlet 6 provided with a wellhead 6*a* at the surface 4.

The system further comprises a reception well 7, penetrating the underground formation 2, and capable of receiving well fluid therefrom through inlet means 8, wherein the downstream part 9 of the reception well 7 comprises a substantially horizontal section 10, wherein during normal operation primary separation of well fluid takes place. The reception well 7 is arranged to connect at junction 11 to the production well 3 upstream of the inlet 5.

Furthermore, a water discharge system 12 is provided, having an upstream end 13 that is arranged to receive during normal operation liquid from the lower region 14 of the downstream part 9 of the reception well 7.

Optionally, weirs, apertures, splitters, packers or the like (not shown) may be arranged in or near the upstream end 13 and/or the junction 11, to guide and keep separated the streams of fluid components.

The water discharge system 12 in this example is arranged in a downward extension of the production well 3 below the junction 11, wherein the cross section of the extension can differ from that of the production well 3.

Further, the water discharge system 12 has a port 15 for receiving a water-enriched component, and a pump 16, which is arranged to discharge liquid from the water discharge system into a well section 17 downstream of the pump 16. The well section 17 is suitably arranged to allow injection of the liquid from the water discharge system into an underground formation (not shown), and the well section 17 is further provided with means to prevent water from flowing back.

In addition there is provided a secondary underground oil/water separator 18 having at its upstream end an inlet 19 that is capable of receiving during normal operation liquid from the upper region 20 of the downstream part 9 of the reception well 7. The separator 18 has an outlet 21 for de-watered oil that is in fluid communication with the inlet 5 of the production well 3, and an outlet 22 for a water-enriched component that is connected via conduit 23 with the port 15 in the water discharge system 12. The separator in this example is arranged in a section of the production well 3, which section is arranged above the junction 11 in such a way that the separator can not be bypassed during normal operation. The section of the production well 3 in which the separator 18 is arranged can be underreamed.

During normal operation of a system 1 according to the embodiment shown in FIG. 3, the well fluid received through the inlet means 8 of the reception well 7 flows to the downstream part 9 including the horizontal section 10, and separates. Liquid layers are formed in the upper and lower regions of the downstream part 9 of the reception wellbore 7, and an interface is formed between the layers (not shown). Near the downstream end of the reception wellbore 7 the liquid flowing in the lower region 14 is a water-rich component, and the liquid flowing in the upper region 20 is an oil-rich component of the well fluid. The flow of the well fluid is separated in this primary separation step to the extent, that the water-rich component has sufficiently low oil concentration.

The water-rich component enters the water discharge system 12 at the upstream end 13 near the junction 11.

The oil-rich component enters the secondary separator 18 through the inlet 19, and is separated into de-watered oil, containing typically less than 10 vol % of water, preferably less than 2 vol %, more preferably less than 0.5 vol % of water, and a water-enriched component, that can contain between 0.01 vol % and 0.1 vol % of oil. The separation efficiency depends in part on the type of separator that is used.

The de-watered oil leaves the separator 18 via the outlet 21 and flows on through inlet 5 into the production well 3 and further to the surface 4, where it is discharged from the system 1 through the wellhead 6*a* at the outlet 6. The water-enriched component leaves the separator via the outlet 22 and conduit 23 and mixes at port 15 with the water-rich component to form de-oiled water in the water discharge system 12. During normal operation, the water discharge system 12 will be filled up to a certain water level (not shown) with de-oiled water. The de-oiled water is discharged via well section 17 by means of pump 16.

As becomes clear from the foregoing description of the system depicted in FIG. 3, a particular advantage of the present invention is, that the well fluid is separated into de-watered oil and de-oiled water. In the event, that the de-oiled water is discharged into an underground formation, the system according to the present invention produces only de-watered oil to the surface.

The curvature of the well section between the substantially horizontal section 10 and the junction 11 is designed such that the quality of separation does not substantially deteriorate.

Figure 4:
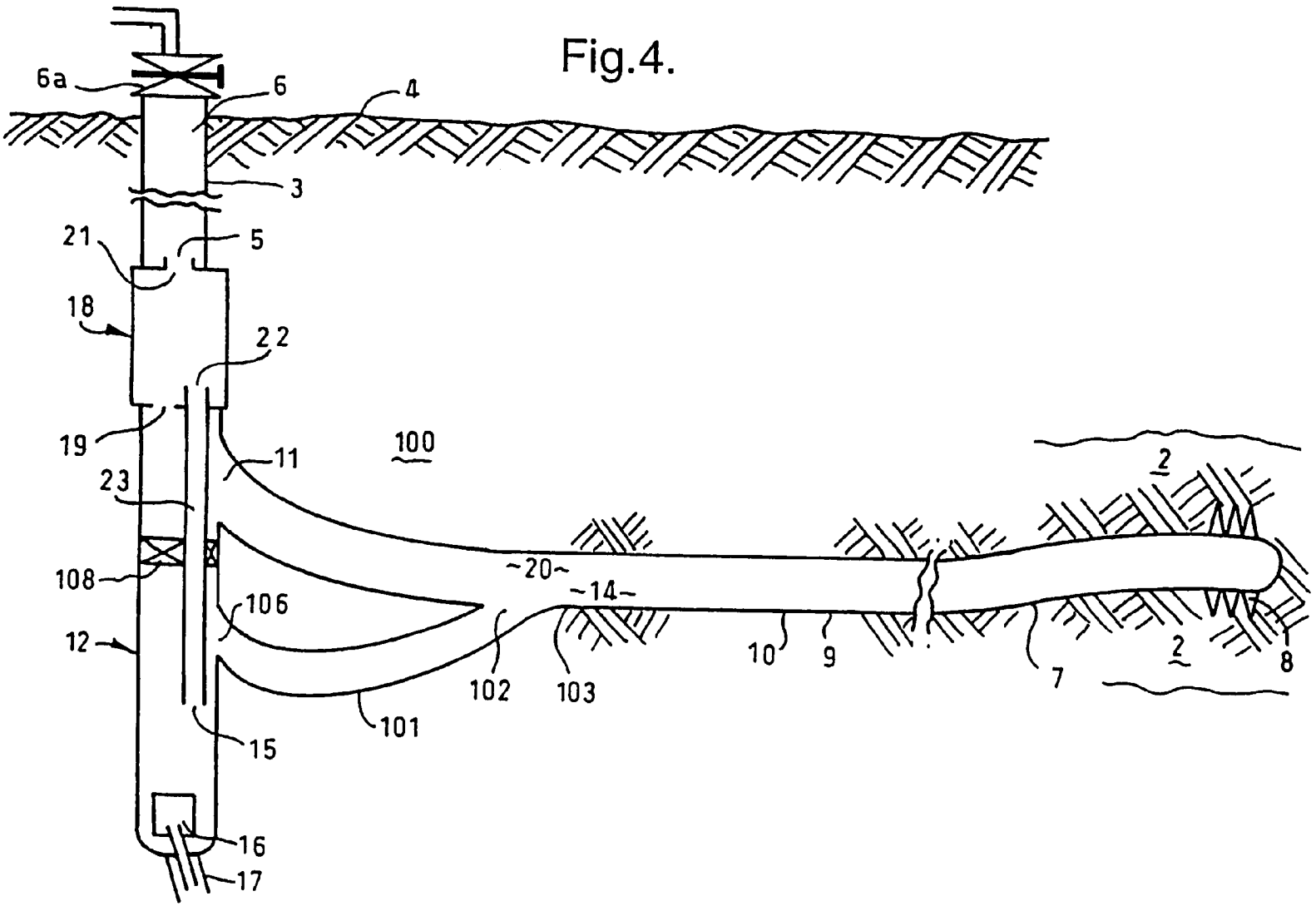
FIG. 4 shows schematically a second embodiment of the present invention.

Reference is now made to FIG. 4, which schematically shows another embodiment of the present invention. Parts that are similar to parts discussed with reference to FIG. 3 are referred to with the same reference numerals. The system 100 is an extension of the system 1 shown in FIG. 3 in that it further comprises a connection well 101. The connection well 101 in this embodiment is arranged such that it connects to the reception well 7 at a junction 102 near the downstream end 103 of the substantially horizontal section 10, and to the water discharge system 12 at a junction 106 below the junction 11. The inlet of the connection well 101 is arranged at junction 102 so as to receive fluid from the lower region 14, and the outlet of the connection well 101 at junction 106 is in fluid communication with the water discharge system.

U.S. Pat. No. 4,390,067 discloses a well system comprising at least two wellbores extending downward from the surface, and connected by at least one generally horizontal wellbore.

During normal operation of the system 100, the water-rich component does not enter the water discharge system from the junction 11. To this end, optionally a packer 108 can be arranged just below the junction 11, which packer suitably has an opening for a conduit 23 connecting the outlet 22 to the port 15.

Figure 5:
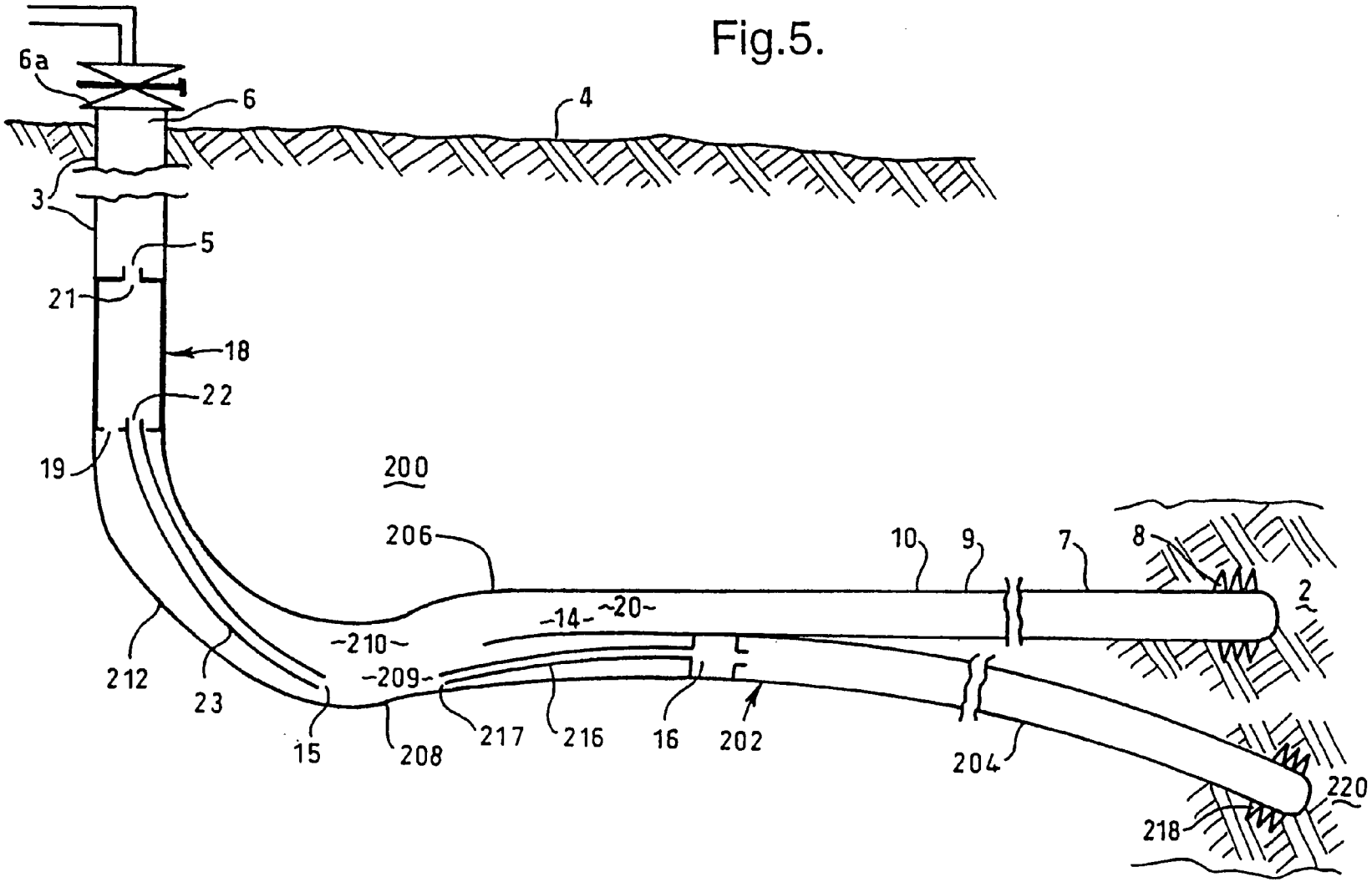
FIG. 5 shows schematically a third embodiment of the present invention.

Reference is now made to FIG. 5, which shows schematically a third embodiment of the present invention. Parts that are similar to parts discussed with reference to FIG. 3 are referred to with the same reference numerals. The system 200 shown in FIG. 5 differs from the system 1 shown in FIG. 3, in that the water discharge system 202 comprises a water discharge well 204 that is arranged as a branch of the reception well 7. The junction 206 of the wells 7 and 204 is arranged near the outlet of the substantially horizontal section 10 of the downstream part 9 of the reception well 7.

During normal operation, well fluid undergoes primary separation in the substantially horizontal section 10 and enters, when passing the junction 206 near the downstream end of the horizontal section, a section 208 having a lower region 209. The lower region 209 receives the water-rich component from the lower region 14 of the downstream part 9 of the reception well 7.

During normal operation, the oil-rich component of the well fluid flows in a layer in the upper region 210 of the section 208 and then through an upwardly curved well section 212. From the well section 212 it enters the secondary oil-water separator 18 through the inlet 19. In the oil-water separator 18 the oil-rich component is separated into de-watered oil, and a water-enriched component. The de-watered oil leaves the separator 18 via the outlet 21 to inlet 5 of the production well 3, and further to the surface 4, where it is discharged from the system 200 through the wellhead 6*a* at the outlet 6. The water-enriched component leaves the separator via the outlet 22 and flows through conduit 23 to port 15 that is arranged in the lower region 209 of the section 208. There, the water-enriched component mixes with the water-rich component to form de-oiled water.

Via conduit 216 having an inlet 217 arranged in the lower region 209, the de-oiled water is received by the water discharge system 202. By means of pump 16 the de-oiled water is pumped through the water discharge well 204, and disposed through outlet means 218 into the underground formation 220.

Figure 6:
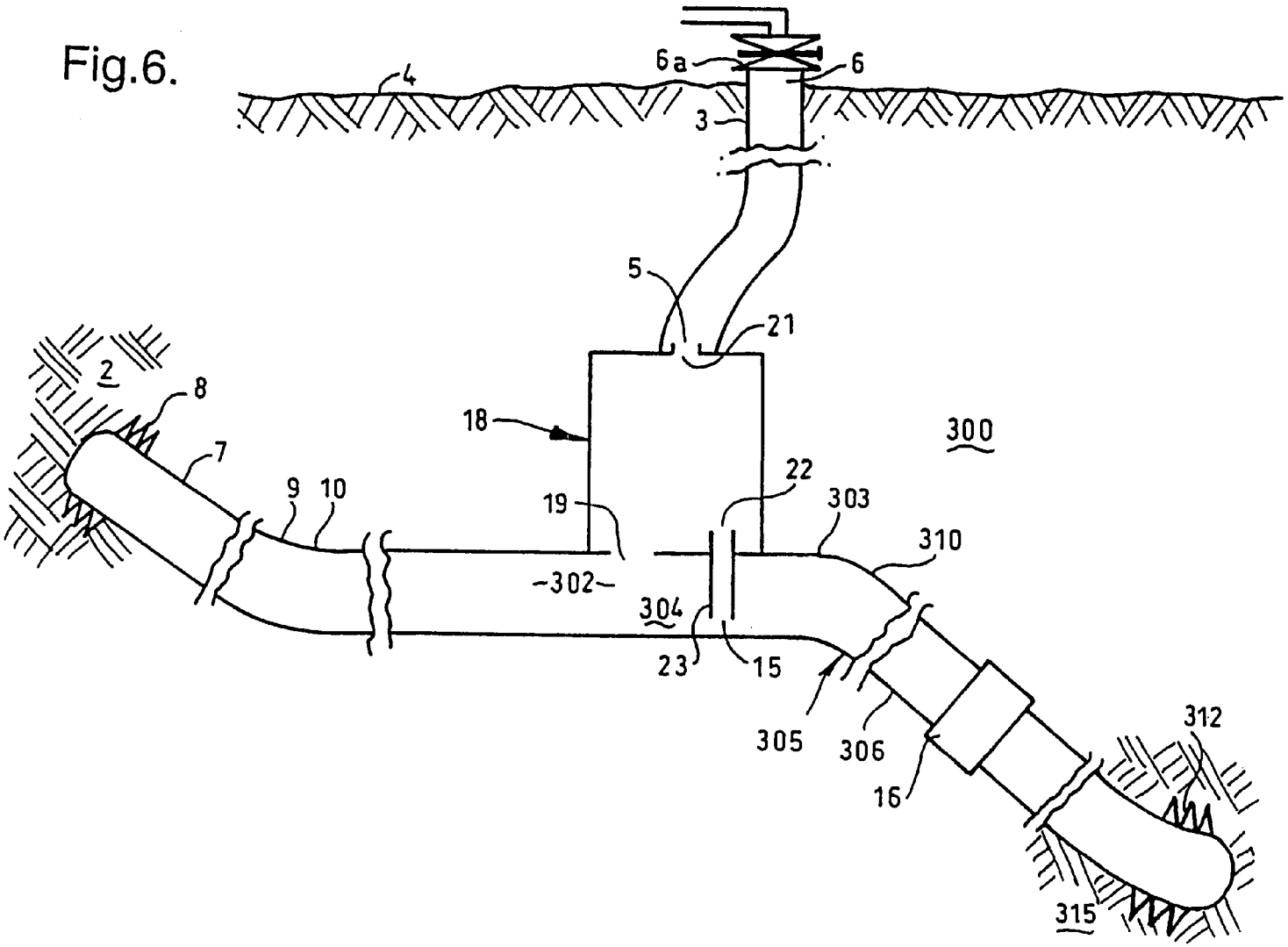
FIG. 6 shows schematically a fourth embodiment of the present invention

Reference is now made to FIG. 6, which shows schematically a fourth embodiment of the present invention. Parts that are similar to parts discussed with reference to FIG. 3 are referred to with the same reference numerals. The system 300 shown in FIG. 6 differs from the system that has been discussed with reference to FIG. 3 in the arrangement of the secondary oil-water separator and of the water discharge system.

The secondary oil-water separator 18 of the system 300 is arranged in an underreamed section at the lower end of the production well 3. The separator 18 is arranged to receive, through its inlet 19, liquid from the upper region 302 of the horizontal section 10 of the downstream part 9 of the reception well 7, wherein the separator 18 is located near the downstream end 303 of the horizontal section 10. The oil-water separator 18 further has an outlet 21 for de-watered oil that is in fluid communication with the inlet 5 of the production well 3, and an outlet 22 for a water-enriched component. Outlet 22 is connected via conduit 23 to port 15, which port 15 is arranged in the lower region 304 of the horizontal section 10, near the downstream end 303 of the horizontal section 10.

The water discharge system 305 in this embodiment comprises a water-discharge well 306 of which the slope declines in the direction of fluid flow. The water-discharge well 306 has an inlet 310 at its upper end that connects to the downstream end 303 of the horizontal section 10. The slope of the water-discharge well 306 is selected such that an incoming stratified flow is not substantially disturbed.

Downstream in the water-discharge well 306, at a position below the lowest level of the horizontal section 10, a pump 16 is arranged to discharge the de-oiled water through outlet 312 into the underground formation 315, and there is further provided means to prevent water from flowing back (not shown).

During normal operation of a system 300 as shown in FIG. 6, the well fluid received through the inlet means 8 of the reception well 7 flows to the downstream part 9 including the horizontal section 10, which acts as primary separator for the well fluid. Liquid layers are formed in the upper and lower regions of the horizontal section 10, and an interface is formed between the layers (not shown). Near the downstream end 303 of the horizontal section 10 the liquid flowing in the lower region 304 is a water-rich component, and the liquid flowing in the upper region 302 is an oil-rich component of the well fluid. The flow of the well fluid is separated to the extent, that the water-rich component has sufficiently low oil concentration.

The oil-rich component enters the secondary separator 18 through the inlet 19, and is separated into de-watered oil and a water-enriched component, wherein the de-watered oil is passed to the surface 4 as described with reference to FIG. 3. The water-enriched component leaves the separator through the outlet 22 and conduit 23 and mixes near port 15 in the lower region 304 with the water-rich component to form, downstream of port 15, de-oiled water.

The de-oiled water is received by the water-discharge well 306 through inlet 310. Below the lowest level of the substantially horizontals section the water-discharge well will, during normal operation, be filled with de-oiled water. By means of pump 16 the de-oiled water is pumped through the water-discharge well 306, and disposed through outlet means 312 into the underground formation 315.

It may be desirable to produce oil from multiple reception wells by using a single production well and a single oil/water separator. In this case, the system according to the invention comprises one or more additional reception wells, which penetrate the underground formation at different locations and receive well fluid therefrom, wherein the downstream parts of the additional reception wells are in fluid communication with the downstream part of the reception well. The separation of well fluid into water-rich and oil-rich components may occur in the multiple reception wells individually, or in a common downstream part after mixing all well fluid, or partly in both ways.

In the International Patent application with publication No. WO 98/25005 is disclosed an underground well system comprising a substantially vertical wellbore and one or more horizontal well sections extending from the vertical wellbore.

In the International Patent application with publication No. WO 98/50679 is disclosed an underground well system comprising a main well and one or more additional wells, wherein each well extends downwardly from the surface and comprises a substantially horizontal section arranged in a production formation. The horizontal sections of the additional wells are in fluid communication with the horizontal section of the main well through the production formation, but do not physically intersect with the main well.

The underground oil/water separator for use in a system according to the present invention can be of various types known in the art, such as for example a cyclone, a coalescer, or a static separator. With advantage the separator is a static one, which is arranged in a separation chamber, wherein the height of the separation chamber is larger than the thickness of the oil/water dispersion band that is formed therein under normal operation conditions. The separation chamber can with advantage be arranged in an underreamed section of the production well.

It has been recognized that in an underground separation chamber one can take advantage of the physical conditions in the well, e.g. elevated temperature and pressure, which influence the separation behaviour of oil and water such that efficient separation of the liquid received from the upper region of the downstream part of the reception well into relatively dry oil and relatively pure water can be achieved under practically and economically feasible conditions.

The liquid received during normal operation by a static separator from the upper region of the downstream part of the reception well is an oil-rich component of the well fluid in the form of an oil/water dispersion, containing more than 10 vol % of water. The separation of such an oil/water dispersion in a separation chamber under the influence of gravity can be described by means of a model developed by Applicant. This so-called Dispersion Band Model, is published in H. G. Polderman et al., SPE paper No. 38816, 1997. The model can be used to describe separation in a separation chamber. An important mechanism of separation is based on coalescence of small water droplets in the dispersion band, which sink to the lower layer once the drops have grown large enough. During normal operation, three liquid layers are formed: a bottom layer of relatively pure water, a middle layer containing an oil and water dispersion and an upper layer of relatively dry oil. The middle layer is also referred to as the dispersion band.

Suitably, the inlet and the outlets of the separator are arranged such that the feed and the separated components flow vertically or nearly vertical in and out of the separation chamber.

In a first embodiment of such a static separator the separator further comprises a flow distributor means, arranged to distribute at a predetermined vertical position the liquid over the cross-sectional area of the separation chamber. Preferably, the liquid is admitted into the separation chamber at a predetermined vertical position through one or more openings at a local flow velocity below 1 m/s. In the separation chamber the liquid is allowed to separate into a lower layer of a water-enriched component, a middle layer of an oil and water dispersion component and an upper layer of an de-watered oil component. Liquid from the upper and lower layers can be withdrawn via the outlets for de-watered oil and the water-enriched component, respectively. The separator can further comprise a level detector means for measuring the vertical position of the interface between two liquid layers and a flow control means in order to maintain during normal operation an interface between two liquid layers at a predetermined vertical level.

In a second embodiment, a static separator for use as secondary separator with the present invention further comprises

- a stack of vertically spaced apart inclined plates, wherein between each pair of neighbouring plates a separation space is defined;
- a substantially vertical inlet conduit communicating with the separator's upstream end, which inlet conduit traverses the stack of plates and is arranged to receive the liquid from the upper region of the downstream part of the reception well at its lower end, and is provided with one or more fluid outlets each of which opens into a separation space;

a substantially vertical oil collection channel having an oil outlet at its upper end communicating with the separator's outlet for the de-watered oil, which oil collection channel has one or more oil inlets, each oil inlet being arranged to receive fluid from the uppermost region of a separation space, wherein at least the plate immediately below each oil inlet is provided with a vertically upward pointing baffle; and a substantially vertical water collection channel having a water outlet at its lower end communicating with the separator's outlet for the water-enriched component, which oil collection channel has one or more water inlets, each water inlet being arranged to receive fluid from the lowermost region of a separation space, wherein at least the plate immediately above each water inlet is provided with a vertically downward pointing baffle.

Figure 8:
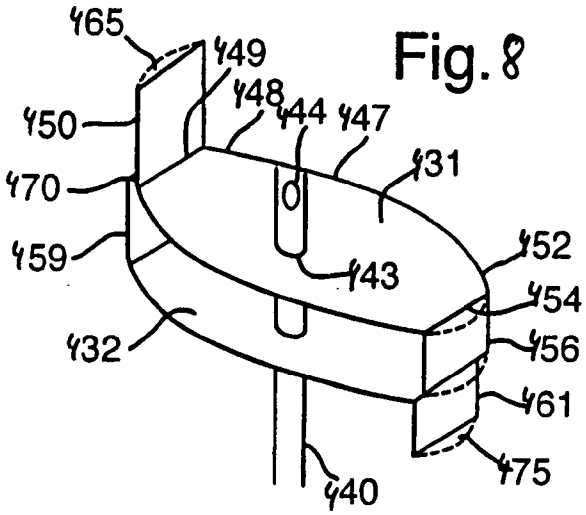
FIG. 8 shows schematically a detail of the embodiment of the static separator shown in FIG. 7.
Figure 7:
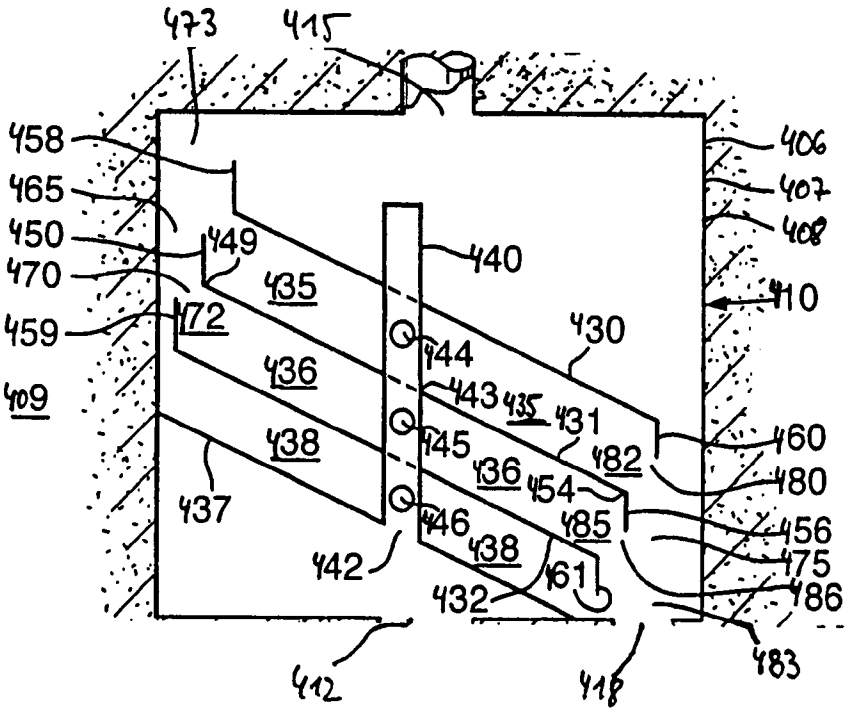
FIG. 7 shows schematically an embodiment of a static separator suitable for use as secondary separator in the present invention.

Reference is now made to FIGS. 7 and 8. FIG. 7 shows an example of a static separator 410 which is arranged in a separation chamber 406 in an underreamed section of the production well (not shown). The separation chamber 406 has a substantially circular cross section. The vertical wall 408 of the separation chamber 406 is formed by the surrounding formation 409, but it will be understood that the wall can also be provided by a well tubular, such as a casing. The wall of the separation chamber also forms the wall of the separator. The static separator 410 comprises a stack of inclined, substantially flat plates 430, 431, 432 that are arranged substantially parallel to each other and vertically spaced apart at an equal distance. The space delimited between two neighbouring plates is referred to as the separation space. For example, plates 430 and 431 define the separation space 435, plates 431 and 432 define the separation space 436. Underneath the lowest plate 432 of the stack of plates a parallel base plate 437 is arranged, wherein the outer rim of the base plate sealingly engages the walls of the separation chamber 406. Between the plate 432 and the base plate 437 a further separation space 438 is defined.

The stack of plates is traversed by the inlet conduit 440, which extends vertically upwardly from an opening 442 through the stack of plates in the centre of the separation chamber 406. The passage of the inlet conduit through a plate, for example the passage 443 through plate 431, is thereby arranged such that the wall of the inlet conduit 440 sealingly fits to the plate, for example plate 431, thereby preventing fluid communication between neighbouring separation spaces, for example separation spaces 435 and 436, along the inlet conduit. Further, the inlet conduit is provided with radial outlet openings 444, 445, 446, which open into the separation spaces 435, 436, 438, respectively. It will be clear, that further outlet openings can be arranged opening into different radial directions. An outlet opening is with advantage arranged in the direction of the axis in the horizontal plane around which the plates are inclined, i.e. in FIG. 7 an axis perpendicular to the paper plane.

Further details about the inclined plates will now be discussed with reference to FIG. 8, wherein schematically the plates 431 and 432 of FIG. 7 are shown. The rim 447 of plate 431 includes at the upper side 448 of the plate 431 a straight edge 449 to which an upward pointing baffle plate 450 is attached. At the lower side 452 the rim 447 includes a straight edge 454 to which a downward pointing baffle plate 456 is attached.

Referring again to FIG. 7, the other inclined plates of the stack of plates are similarly provided with upward and downward pointing baffles 458, 459, 460, 461 at the their upper and lower sides, respectively. The remaining parts of the rim of each inclined plate to which no baffle is attached are arranged to sealingly engage the wall 408.

The static separator 410 further comprises an oil collection channel 465, which is formed by the space segment delimited by the upward pointing baffles, 458, 450, 459, and the wall 408. The oil collection channel 465 comprises oil inlets, for example oil inlet 470 arranged to receive fluid from the uppermost region 472 of the separation space 436. Oil inlet 470 is defined by the upper edge 449 of the plate 431 and the upward pointing baffle 459 of the plate 432 immediately below the oil inlet 470. The oil collection channel 465 further comprises an outlet 473 in communication with the outlet 415 of the static separator 410.

Opposite to the oil collection channel 465 the separator 410 comprises a water collection channel 475, which is formed by the space segment delimited by the downward pointing baffles, 460, 456, 461, and the wall 408. The water collection channel 475 comprises water inlets, for example water inlet 480 arranged to receive fluid from the lowermost region 482 of the separation space 435. Water inlet 480 is defined by the lower edge 454 of the plate 431 and the downward pointing baffle of the plate 430 immediately above the water inlet 480. The water collection channel 465 further comprises an outlet 483 in communication with the outlet 418 of the separator 410.

The plates 430, 431 and 432 with the attached baffles are arranged such that the shortest horizontal distance between an upward pointing baffle and the wall 408 increases from bottom to top, and that the shortest horizontal distance between a downward pointing baffle and the wall 408 increases from top to bottom. In this way the cross-sectional areas of both the oil collection channel 465 and the water collection channel 475 increase in the direction towards their respective outlets 473 and 483. Since the separator 410 does not contain parts that are moving during normal operation it represents a static oil-water separator.

During normal operation fluid enters the static separator 410 its upstream end 412, enters the inlet conduit 440 at the opening 442 and is admitted into the interior of the separation spaces 435, 436, 437 via the outlet openings 444, 445 and 446. It has been found that good separation results are obtained if all openings have the same cross-sectional area. Good results are obtained if the diameter of the openings is of the order of the diameter of the inlet conduit, such that the pressure drop over the opening is small.

The separation will now be discussed. To this end we take a closer look on the separation space 436 between plates 431 and 432. In this separation space 436, three liquid layers are formed, an upper, de-watered oil layer, a middle dispersion band layer and a lower, water-enriched layer. The de-watered oil layer flows towards the uppermost region 472 of the separation space 436, from where it leaves the separation space to enter the oil collection channel through inlet 470. The water-enriched layer flows towards the lowermost region 485 of the separation space 436, from where it enters the water collection channel through inlet 486. Separation in the spaces 435 and 435 is similar. The oil collection channel 465 receives a de-watered oil component from all separation spaces, and since the cross-section of the channel widens towards the outlet 473, the vertically upward flow velocity of the de-watered oil component in the channel 465 can remain substantially constant. From the outlet 473 the collected de-watered oil component flows to the separator's outlet for de-watered oil 415.

The water-collection channel 475 receives a water-enriched component from all separation spaces, and since its cross-section widens from top to bottom towards the outlet 483, the vertically downward flow velocity of the water-enriched component in the channel 475 can remain substantially constant. From the outlet 483 the collected water-enriched component flows to the separator's outlet for a water-enriched component 418.

In a further embodiment the inclined plates can have substantially the form of funnels arranged substantially parallel to each other, wherein each funnel is provided with a central opening.

By installing a stack of vertically spaced apart inclined plates the efficiency of a separation chamber can be increased, i.e. a chamber of smaller height can handle the same specific throughput as a larger separation chamber without a plate pack. In practice often a reduction of the required height of the separation chamber by a factor in the range of from 1.5 to 6 can be achieved. Sometimes, the height of the separation chamber is not a limiting factor for the well design, and in this case a separator without a stack of plates can be used.

Typical dimensions of the separation chamber have been calculated using the Dispersion Band Model under the following assumptions: gross flow rate through the separator 1000 $m^3$/day of well fluid containing 50 vol % of water, dry oil viscosity 0.001 Pa.s. In this case a separation chamber of about 1 m diameter and 5 m height is required. For comparison it is noted that by installing a stack of plates in the separation chamber the height requirement can be decreased to for example 2 m. Suitably the height/diameter ratio of the separation chamber is smaller than 6, wherein under diameter is understood the diameter of a circle having the same cross-sectional area as the volume of the separation chamber divided by its height.

It will be appreciated, that in practical applications of the present invention additional technical measures may be implemented which are well known in the art and of which the expert is master. By way of example some of those measures will briefly be described hereinafter.

The wells of a system according to the present invention, or sections thereof, may be provided with casing, tubing, packing, flow controllers, measurement equipment, data communication lines, power transfer lines to underground equipment or other means known in the art for operating and controlling a well system.

In the event that the well fluid comprises in addition to oil and water also gas, it is possible that in the downstream part of the reception well a gas layer is formed on top of the layer in which the remainder liquid flows. Gas may decrease the separating efficiency of the separator. It may therefore be advantageous to arrange an outlet for gas connected to a gas-discharge system for gas at a suitable position in the system.

It may be desirable to perform measurements using underground equipment. This may be of advantage for monitoring and controlling the operation of the system.

As an example, measurement equipment may be installed to monitor the oil, gas or water content of fluids at certain positions in the system. E.g., the water or oil content of the de-oiled water, the water-rich component, the water-enriched component, or of the de-watered oil, may be measured by suitable equipment.

Further, although the exact vertical level of an interface between layers of different components at a certain position in the system is generally not critical for the function of the system, and may vary within predetermined limits, it may be desirable to measure the level by a detector.

The result of such a measurement may e.g. be used to control the flow rate of a fluid at a certain position in the system to stay within predetermined limits. It is well known in the art how to control a flow rate in a system according to the present invention, e.g. the flow rate of inflowing well fluid, liquid from the upper region or from the lower region of the downstream part of the reception well, de-oiled water or de-watered oil. To this end, the system may comprise controllable valves, pumps, restrictions, movable sleeves, adjustable apertures or other suitable equipment.

It may be desirable to promote the separation of fluid components by physical or chemical means, e.g. by the injection of chemicals that are known in the art.

In the event that an inclined well section is provided for primary separation of the well fluid, it can be advantageous to arrange at the downstream end of the inclined section, in the area upstream of and around the secondary separator, a substantially horizontal section, which can be for example up to 100 meters long.

It will be appreciated, that the de-oiled water can be injected in the underground formation, from which well fluid is removed. In this way, the injection of de-oiled water can serve to maintain the pressure in the underground formation.

Thus, the present invention provides a system for producing oil from an underground formation to the surface, wherein the oil can be de-watered below the surface, such that the water concentration of the produced oil is sufficiently low that no further de-watering at the surface is needed before the oil can be transported away from the wellhead.

What is claimed is:

1. System for producing de-watered oil from an underground formation to the surface, said system comprising:

a production well extending downwardly from the surface and having an inlet below the surface;

a reception well penetrating the underground formation and capable of receiving well fluid there from, wherein the downstream part of the reception well comprises a substantially horizontal or inclined section for primary oil/water separation of the well fluid;

a water discharge system having an upstream end that is capable of receiving during normal operation a water-rich liquid from the lower region of the downstream part of the reception well; and a secondary underground oil/water separator, characterized in that the secondary separator has an upstream end that is capable of receiving during normal operation only an oil-rich liquid from the upper region of the downstream part of the reception well, the secondary separator having an outlet for de-watered oil that is in fluid communication with the inlet of the production well and an outlet for a water-enriched component that is in fluid communication with the water discharge system.

2. The system according to claim 1, wherein the water discharge system comprises means to inject the liquid from the lower region and the water-enriched component into an underground formation.

3. The system according to claim 1, further comprising a connection well, wherein the connection well has an inlet arranged to receive liquid from the lower region of the downstream part of the reception well, and an outlet in fluid communication with the water discharge system.

4. The system according to claim 1, wherein the water discharge system comprises a water discharge well that is a branch of the reception well.

5. The system according to claim 1, wherein the water discharge system comprises a water-discharge well of which the slope declines in the direction of fluid flow.

6. The system according to claim 1, further comprising an additional reception well arranged to receive well fluid from the underground formation, wherein the downstream part of the additional reception well is in fluid communication with the downstream part of the reception well.

7. The system according to claim 1, further comprising underground measure equipment to measure a characteristic of a fluid at a certain position in said system.

8. The system according to claim 7, wherein the characteristic is a concentration of a component in a fluid.

9. The system according to claim 7, wherein the characteristic is the vertical level of an interface between layers of different components of the well fluid at a certain position in the system.

10. The system according to claim 1, further comprising means to control the flow of a fluid at a certain position in said system.

11. The system according to claim 7, wherein said system comprises means to control the flow of a fluid at a certain position in said system, and wherein data obtained from the underground measure equipment is used as input for the means to control the flow of a fluid.

12. The system according to claim 1, wherein the secondary underground oil/water separator is selected from the group comprising a cyclone, a coalescer, or a static separator.

13. The system according to claim 12, wherein the secondary separator is a static separator which is arranged in a separation chamber, and wherein the height of the separation chamber is larger than the thickness of the dispersion band that is formed therein under normal operation conditions.

14. The system according to claim 13, wherein the static separator further comprises a flow distributor means, arranged to distribute at a predetermined vertical position the well fluid received through the separator's inlet over the cross-sectional area of the separation chamber.

15. The system according to claim 13, wherein the static separator further comprises a level detector means and a flow control means in order to maintain during normal operation an interface between two liquid layers at a predetermined level.

16. The system according to claim 13, wherein the static separator further comprises a stack of vertically spaced apart inclined plates, wherein between each pair of neighboring plates a separation space is defined;

a substantially vertical inlet conduit communicating with the separator's upstream end, which inlet conduit traverses the stack of plates and is arranged to receive the well fluid at its lower end, and is provided with one or more outlets each of which opens into a separation space;

a substantially vertical oil collection channel having an oil outlet at its upper end communicating with the separator's outlet for de-watered oil, which oil collection channel has one or more oil inlets, each oil inlet being arranged to receive fluid from the uppermost region of a separation space, wherein at least the plate immediately below each inlet is provided with a vertically upward pointing baffle; and a substantially vertical water collection channel having a water outlet at its lower end communicating with the separator's outlet for the water-enriched component, which oil collection channel has one or more water inlets, each water inlet being arranged to receive fluid from the lowermost region of a separation space, wherein at least the plate immediately above each water inlet is provided with a vertically downward pointing baffle.

17. The system according to claim 16, wherein the inclined plates are substantially flat and arranged substantially parallel to each other, wherein each inclined plate is provided with a downward pointing baffle attached to the rim at the lower side of the inclined plate and an upward pointing baffle attached to the rim at the upper side of the inclined plate, wherein the remaining parts of the rim fit sealingly to the wall of the separation chamber, wherein the oil collection channel is formed by the space delimited by the upward pointing baffles and the wall, and wherein the water collection channel is formed by the space delimited by the downward pointing baffles and the wall.

18. The system according to claim 16, wherein the inclined plates have substantially the form of funnels arranged substantially parallel to each other, wherein each funnel is provided with a central opening.

19. The system according to claim 13, wherein the separation chamber has a height/diameter ratio smaller than 6.

20. The system according to claim 1, wherein the secondary underground oil/water separator is arranged in an underreamed section of the production well.

21. A system for producing de-watered oil from an underground formation to the surface, said system comprising:

a production well extending downwardly from the surface and having an inlet below the surface;

a reception well penetrating the underground formation and capable of receiving well fluid there from, wherein the reception well comprises a primary oil/water separation means, the reception well connected to the production well; and a secondary underground oil/water separation means wherein the secondary underground oil/water separation means is effective to remove water from an oil-rich phase produced by the primary oil/water separation means.

* * * * *